United States Patent [19]

Hacking

[11] 4,218,901

[45] Aug. 26, 1980

[54] SYSTEM FOR WORKING LEATHER AND LIKE FLEXIBLE SHEET MATERIAL

[76] Inventor: Joseph F. Hacking, 2388 N. 3500 West, Vernal, Utah 84078

[21] Appl. No.: 916,439

[22] Filed: Jun. 19, 1978

[51] Int. Cl.[2] ..... C14B 19/00

[52] U.S. Cl. ..... 69/21; 69/20

[58] Field of Search ..... 69/20, 21

[56] References Cited

PUBLICATIONS

Encyclopedia of Rawhide & Leather Braiding, Bruce Grant, Cornell Press, 1972, pp. 3, 14, 21 & 23.

*Primary Examiner*—Patrick D. Lawson

*Attorney, Agent, or Firm*—Lynn G. Foster

[57] ABSTRACT

A system, including apparatus and method for cutting leather and like flexible sheet material into straps and/or strips and for sequentially sizing and shaping the straps and/or strips uniformly, the apparatus comprising a cylindrical bar with shaping and sizing circumferential grooves in the surface thereof, a pivotable biased holder carrying a cutting edge disposed at a narrow acute angle across one or both of the mentioned grooves in the cylindrical bar so that undesired portions of the straps or strips are cut off to size and shape the strap or strip as it is forceably drawn between the groove and the mentioned cutting edge. The cylindrical bar also comprises a slot and one or more spacers to hold one or more blades parallel to each other and perpendicular to the body so that a sheet of rawhide, leather or like flexible material may be selectively and simultaneously cut into uniform strips by drawing the sheet through the parallel blades. The shaping and sizing grooves may each have variable depths and shapes, depending upon the circumferential or rotational orientation of the cylindrical bar in respect to the first mentioned blade. Thus, strips of various thicknesses, sizes and shapes may be obtained. The apparatus at a given setting produces uniform straps and strips.

14 Claims, 7 Drawing Figures

SYSTEM FOR WORKING LEATHER AND LIKE FLEXIBLE SHEET MATERIAL

BACKGROUND

1. Field of Invention

The present invention relates broadly to the art of working flexible sheet material and more particularly to a novel system, including method and apparatus, for selectively sizing and shaping straps and strips of rawhide, leather and like flexible sheet material.

2. Prior Art

Heretofore sheets of leather and like flexible material have typically been cut into strips manually using hand-held tools or complex machine cutting operations. These prior art practices have created a number of problems because it is difficult to obtain correctly sized and shaped straps and strips fabricated from leather and like sheet material, e.g. uniform thickness, uniform width and precise bevels at the corners. Accordingly, braided ropes and the like made from strips so fabricated have tended to be irregular, non-uniform and aesthetically displeasing to the eye. The complex machinery heretofore used for the mentioned purposes, while sometimes producing uniform results, tends to be prohibitively expensive, difficult to maintain and complicated to operate and properly adjust. The cost factor alone in terms of initial investment and subsequent maintenance, precludes use of such machinery by the hobbyist or individual leather craftsman.

BRIEF SUMMARY AND OBJECTS OF THE PRESENT INVENTION

With the foregoing in mind, in brief summary, the present invention provides an inexpensive, accurate and non-complex system, comprising method and apparatus, for sizing and shaping rawhide, leather and like flexible sheet material into straps ans strips of uniform thickness and uniform cross sectional configuration. The strips may be subsequently used to produce sewed, laced, braided and like articles having high quality and uniformity. The apparatus may be permanently or releasably mounted to a workbench or the like. Juxtaposed grooves, in a bar, and a biased angularly oriented cutting edge accommodate sizing and shaping of the straps and strips of leather and the like. One or more auxilary blades accommodate cutting rawhide, leather and the like to a desired initial width.

With the foregoing in mind, it is a primary object of the present invention to provide a novel system, including apparatus and method, for sizing and shaping straps and strips from flexible sheet material.

Another paramount object of the present invention is the provision of a tool whereby the cross sectional configuration of strips of rawhide, leather and like flexible material may be uniformly sized and shaped to better serve the intended subsequent use.

Another object of the invention is the provision of an improved tool for cutting sheets of rawhide, leather and like flexible material into straps and/or strips of uniform width.

Another object of the invention is the provision of an apparatus whereby straps and/or strips of rawhide, leather and like flexible material of selectable sizes in cross sectional configuration may be uniformly shaped appropriate to the intended subsequent use thereof.

Another object of the invention is to provide a tool for and method of sizing and shaping strips of rawhide, leather and like flexible material to any one of several uniform thicknesses and cross sectional shapes.

Another object of the invention is the provision of a tool which may be temporarily or permanently mounted for working sheet rawhide, leather and like flexible material into straps and strips having a selectively setable cross sectional configuration.

Another object of the invention is to provide a single, inexpensive, accurate, non-complex, compact, and portable tool used in performing multiple and successive operations in connection with a sheet of rawhide, leather or like flexible material so as to produce a plurality of strips thereof having any one of several precisely uniform cross sections.

Another object of the invention is to provide the individual leather craftsman with a tool useful in inexpensively producing straps and strips of rawhide and leather having great uniformity of shape and pleasing aesthetics.

Another object of the invention is to provide an economical tool permitting the working of sheets of flexible material into a plurality of straps or strips.

Another object of the invention is to provide the individual craftsman with an economical, accurate and non-complex tool useful in producing improved products from flexible sheet material.

These and other objects and features of the present invention will be apparent from the following detailed description taken in reference to the accompanying drawings.

DETAILED DESCRIPTION OF THE ILLUSTRATED EMBODIMENT

Figure 1:
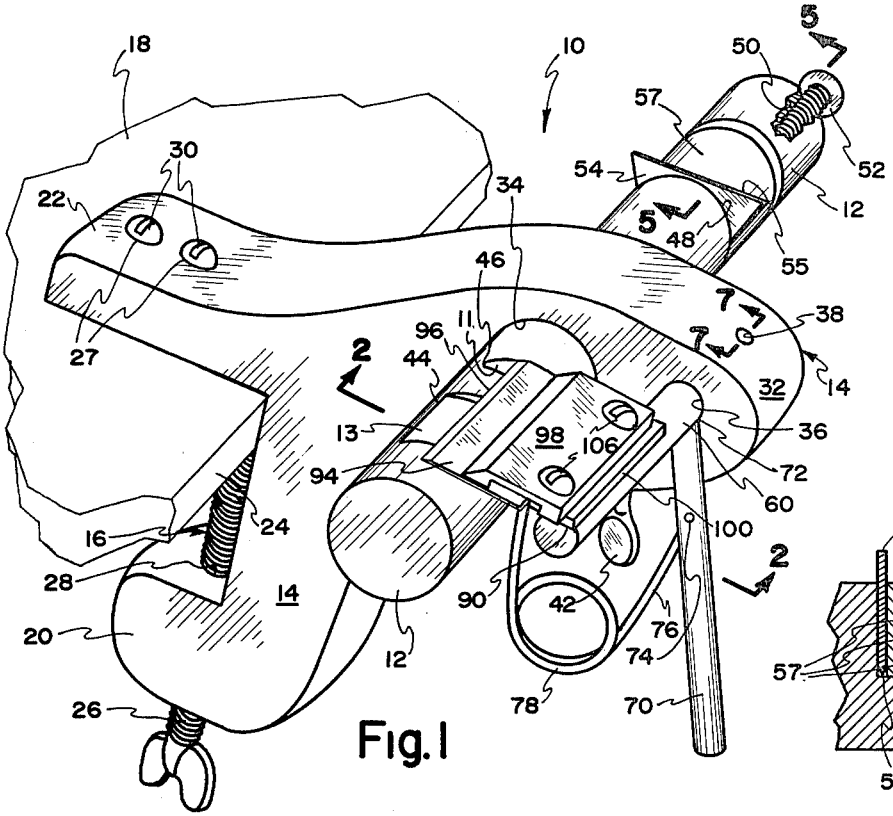
FIG. 1 is a perspective representation of a presently preferred embodiment in accordance with the present invention installed or suitably mounted to the edge of a workbench.
Figure 7:
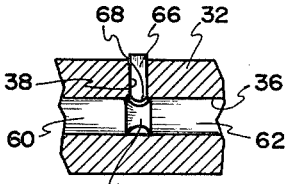
FIG. 7 is an enlarged fragmentary cross sectional view taken along line 7—7 of FIG. 1.

Reference is now made to the drawings wherein like numerals are used to designate like parts throughout. FIG. 1 illustrates a presently preferred rawhide and leather sizing and shaping tool embodiment according to the present invention, generally designated 10. Sizing and shaping tool 10 comprises a body 14, preferably of solid metal or like rigid material, which body 14 comprises a C-clamp 16 facing in a first direction for securely though releasably mounting the tool 10 to a table or workbench 18. Clamp 16 comprises a pair of opposed forwardly projecting jaw elements 20 and 22, which define a rectangular recess 24 therebetween.

A wing screw 26 threadedly engages and passes through a threaded bore 28 in the lower clamp jaw element 20. Wing screw 26 projects upwardly into the jaw space 24, with the shank of wing screw 26 being sufficiently long to traverse all or nearly all of the space 24 between the jaw elements 20 and 22 in a direction substantially transverse to the jaw elements 20 and 22. Accordingly, when the interior surface of top jaw element 22 is contiguous with the top of workbench 18, advancing the wing screw in a upward direction along the threaded bore 28 utlimately causes the C-clamp 16 to firmly engage the workbench 18. If desired, the upper end of wing screw 26 may contain a conventional bearing plate for better load distribution.

Where a permanent or semi-permanent installation is desired, screws 30 may be caused to pass through apertures 27 transversely disposed in jaw element 22 and thence into the material comprising workbench 18.

In addition to vertically disposed C-clamp portion 16, the body 14 comprises a cantilever arm 32, which extends in a direction substantially opposite to the C-clamp 16. The body 14 at cantilever arm 32 presents a transverse, relatively large throughbore 34, the interior of which is smooth and of uniform diameter. In addition, arm 32 defines a second, relatively small throughbore 36 disposed adjacent the end of arm 32. The top surface of the arm 32 presents a very small diameter blind bore 38. A second blind bore 82 also exists at the left side edge of the arm 32 below the large bore 34.

Also, the underside of the arm 32 defines an angular threaded bore 40 which extends between said surface and the interior surface of the large transverse bore 34.

Slidably disposed in the large transverse throughbore 34 is a relatively large circular bar 12. If desired, the bar can be rigidly connected to the arm 32. Circular bar 12 may be fabricated of any suitable material, aluminum being presently preferred. The outside diameter of the circular bar 12 is only slightly less than the interior diameter of the bore 34 so that the bar 12 may be axially and rotationally adjusted by the user for purposes yet to be explained. When a desired axial and rotational position has been obtained for the bar 12, a thumb set screw 42, threadedly carried in the lower threaded bore 40, is threadedly advanced in said bore firmly against the bar 12 to retain the desired position.

As viewed in FIG. 1, the left end of the circular bar 12 presents a tapered, relatively wide groove 13 rectangular in cross section, which merges at 44 with the outside diameter of the circular bar 12. Large tapered groove 13 is used to gauge the thickness of straps ans strips of leather and like flexible sheet material.

Figure 4:
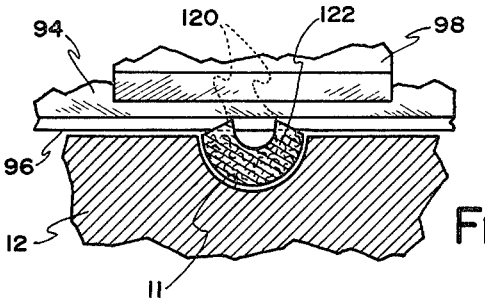
FIG. 4 is an enlarged fragmentary cross sectional view taken along line 4—4 of FIG. 2 showing a strip of leather or like flexible material disposed within a U-shaped groove for bevelling the edges against a biased cutting edge.

In addition, the left end of the circular bar 12 presents a tapered V-shaped groove 11, which is illustrated as being generally coextensive with but offset from groove 13 and merges at site 46 with the outside diameter of bar 12. Groove 11, as illustrated in FIG. 4, assists in cutting bevels symmetrically on opposed side edges of a strip of rawhide, leather or like flexible material.

The right hand end of circular bar 12 (as viewed in FIG. 1) comprises a semi-circular or substantially semi-circular slot 48, which is approximately 90 degrees out of phase with the location of previously mentioned large and small grooves 13 and 11. Other groove arrangements could be utilized without departing from the present invention.

The extreme right end of the circular bar 12 defines a threaded, relatively long axial bore 50, which is parallel though eccentric to the longitudinal axis of the bar 12. A set screw 52 threadedly engages the entirety of the bore 50 and projects into the semi-circular slot 48. The slot 48 serves as a mounting site for one or more strip cutting blades 54.

Figure 5:
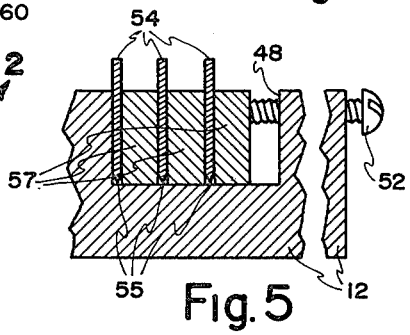
FIG. 5 is an enlarged cross sectional view taken along line 5—5 of FIG. 1.
Figure 6:
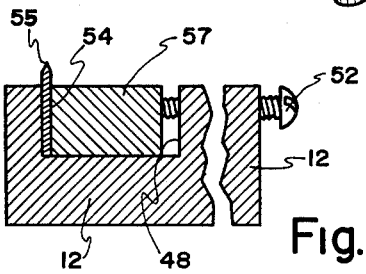
FIG. 6 is a cross sectional view similar to FIG. 5.

One or more blades 54, each having a cutting edge 55 are held within the slot 48 by one or more spacers 57. (See FIGS. 5 and 6). The orientation of the cutting blade may be in either direction perpendicular to the longitudinal axis of bar 12 and the one or more spacers 57 and the one or more blades 54 are compressively held in the slot 48 by causing the previously mentioned screw 52 to be advanced sufficiently into threaded bore 50 of bar 12 so that the leading end thereof is firmly contiguous with the adjacent surface of spacer 57 to compress the spacer(s) 57 and the blade(s) 54 together, as illustrated in FIGS. 5 and 6.

Width indicia 59 is provided near slot 48, which may be used in conjunction with the adjacent blade 54 and axial position of bar 12 in respect to arm 32 to cut straps and strips of rawhide, leather and the like to a desired width.

A relatively small diameter rod 60 extends into the small bore 36 of arm 32 and projects in cantilevered fashion to the left, as viewed in FIG. 1, parallel to but offset from the longitudinal axis of circular bar 12 a distance substantially less than one-half the length of the bar 12. The right end 62 of the rod 60 concealed and rotatably journaled within the arm 32 comprises an annular U-shaped groove 64, which is caused to be placed in alignment with the bore 38 of arm 32. Bore 38 is exposed at the upper surface thereof and a pin 66 is force fit therein, with the lower end 68 of pin 66 being disposed within the rod groove 64. Thus, axial displacement of the rod 60 is prevented while rotational displacement is accommodated.

Figure 2:
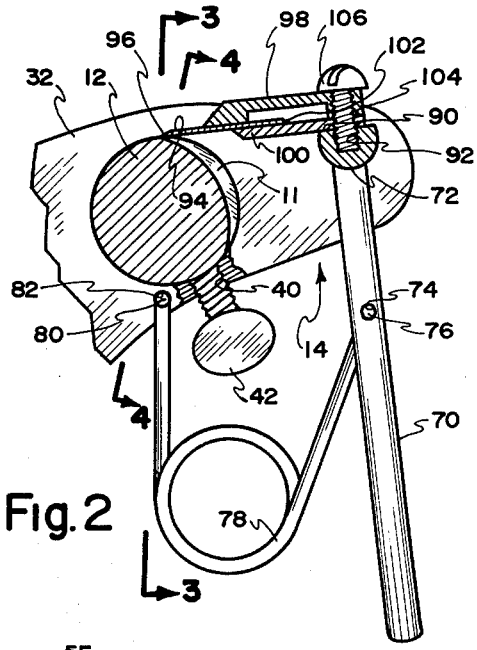
FIG. 2 is a fragmentary enlarged cross sectional view taken along line 2—2 of FIG. 1.
Figure 3:
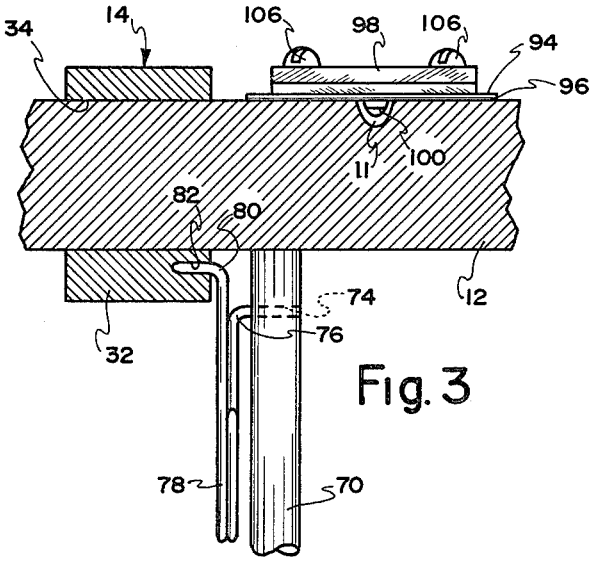
FIG. 3 is a fragmentary enlarged cross sectional view taken along line 3—3 of FIG. 2.

A transverse handle 70 is integral with rod 60 at site 72 and normally extends in a downward diagonal direction, as best illustrated in FIGS. 1 and 2. Thus, rotation of the handle 70 will cause a corresponding rotation of the rod 60.

About one-third down the length of handle 70 is a transverse bore 74, which receives one end 76 of a coiled U-shaped compression spring 78. The opposite end 80 is caused to be placed in blind bore 82 of the arm 32. Thus, the spring 78 urges the handle counterclockwise as viewed in FIGS. 1 and 2. The portion of the rod to the left of handle 70 (as viewed in FIG. 1) defines a flat surface 90. Two threaded blind bores 92 are exposed at surface 90.

A blade 94, of any desired configuration, comprising cutting edge 96 is removably carried by upper and lower holding plates 98 and 100. The blade 94 may be a razor blade or other suitable blade. The plates compressively hold the blade 94 in the illustrated position so the blade projects toward the bar 12 beyond either of the holders 98 and 100. The holder 98 provides a recess 102 into which the dull edge of the blade 94 extends, with the holders 98 and 100 being contiguous along interface 104.

Screws 106, pass loosely through apertures in the holders 98 and 100 (aligned across interface 104) and are threadedly secured in threaded blind bores 92 of rod 60. To remove, replace and/or adjust the length of extension of blade 94 beyond the holders, the screws 106 are slightly loosened, the blade removed, replaced and/or manipulated as desired and the screws retightened when the appropriate steps have been taken and the blade located as desired.

As best illustrated in FIG. 2, the plane of the blade 94 is at a narrow acute angle to a tangent to the exterior circular surface of bar 12 at the point of blade contact. The cutting edge 96 of the blade is caused to forceably contiguously engage the exterior surface of the circular bar 12 by reason of the counterclockwise force imposed upon handle 70 by spring 78. This is true independent of the axial and/or rotational disposition of the bar 12.

In use, normally the operator of tool 10 obtains, for example, prepared rawhide of substantial size. The tool 10 is secured to the workbench 18 or the like. The rawhide may be several inches wide and up to several feet in length, although other widths and lengths are available. The piece of rawhide may be cut into widths of a desired amount by pulling the rawhide workpiece through the cutting edge 55 of one blade 54 in respect to the indicia 59 on bar 12 (with the bar 12 appropriately set in relation to the arm 32). Of course, the rawhide is first pushed against the blade to commence a cut and, thereafter, pulled as indicated with a force parallel to the plane of the blade. A strip or strap of leather having any desired width may be so obtained.

Where a plurality of blades 54 are used, the procedure is similar but a plurality of strips are simultaneously created. The indicia 59 is not used. If the blades are equally spaced one from another, the strips are of equal width. If not, the width of the strips will correspond to the spacings between the blades.

Providing straps or strips of precise thickness may be accomplished using tapered broad groove 13. To do so, the set screw 42 is loosened and the circular bar 12 displaced from left to right from the position shown in FIG. 1 until the broad tapered groove 13 is coextensive with the cutting edge 96 of blade 94. The circular bar 12 is also rotated until the depth of the groove 13 immediately adjacent the cutting edge 96 of blade 94 equals the thickness desired. The thumb set screw 42 is then tightened against the bar 12.

Next, the leading end of a strap having a width equal to or less than the width of the groove 13 is caused to be placed clockwise into the groove 13 (as viewed in FIG. 1) with the handle 70 manually rotated clockwise counter to the force of spring 78. This in turn causes the blade 94 to correspondingly rotate in a clockwise direction to lift the cutting edge 96 from the surface of the bar 12. Once the leading end of the mentioned strap is in position, the handle 70 is released such that spring 78 returns the cutting edge 96 into contiguous forceable engagement with the exterior surface of the bar 12 over the groove 13. By pulling the strap along the groove 13 across the cutting edge 96, any irregularities in thickness are shaved off and the resulting strap has a uniform thickness (except for the leading end).

The strap is reversed so that the previously mentioned leading end becomes the trailing end and is outside the groove 13, following which the strap is oriented in the groove 13 and pulled as earlier mentioned to remove any excess thickness of the strap at the leading end. While obtaining a uniformly thick strap as has been described, one or more strips, laces or strings may in like fashion be trimmed to provide for uniform thickness.

It is sometimes desirable to bevel the side edges of a strip lace, or string of rawhide, leather or like flexible material. This is accomplished by axially placing the circular bar 12 directly under the the cutting edge 96 of the blade 94 by manipulation of the thumb set screw 42 and bar 12 so that the position illustrated in FIG. 1 is obtained. While the thumb screw 42 is loosened, the circular bar 12 is rotated until the degree of bevel desired is established, which will depend, inter alia, upon the thickness and width of the strip to be bevelled. The leading end of the strip in question is thereafter placed in the V-shaped groove 11 with the handle 70 counterbiased clockwise to remove the cutting edge 96 from the surface of the circular bar 12. Thereafter, the strip 122 of rawhide or the like is pulled through the groove 11 against the cutting edge 96 to provide edge bevels 120 (FIG. 4). Thereafter, the placement of the strip in groove 11 is reversed and the leading end caused to be pulled along the groove 11 through the cutting edge 96 to likewise bevel that portion of the strip 122. Bevelled strips have been found useful in making laced and braided articles of rawhide, leather and the like and in using the resulting beveled strips as strings and for sewing, in that strips so uniformly bevelled and having consistent thickness and width produce leather and like goods having a superior appearance.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Untied States Letters Patent is:

1. A multi-purpose tool for sizing rawhide, leather and like flexible sheet material comprising:

body means;

adjustable means connected to and carried by the body means for securely anchoring the tool at a selected site for use;

means carried by the body means having at least one groove in an exposed surface thereof;

means carried by the body means comprising an exposed cutting edge;

means holding the exposed cutting edge contiguous with the exposed surface in angular superposition over the groove;

whereby pulling of said material through the groove against the cutting edge will cut excess material from the sheet.

2. A multi-purpose tool for sizing rawhide, leather and like flexible sheet material comprising:

body means;

means carried by the body means for securely anchoring the tool at a selected site for use;

means carried by the body means having at least one groove in an exposed surface thereof, said exposed surface means being substantially circular in cross section and the groove therein being rectangular in cross section at any point but the depth of the groove being circumferentially tapered from beginning to end;

means carried by the body means comprising an exposed cutting edge;

means holding the exposed cutting edge contiguous with the exposed surface in angular superposition over the groove and means for selectively setting the location of the superposition of the cutting edge over the groove to correspondingly set the amount of excess material to be removed and the ultimate thickness of the resulting sheet;

whereby pulling of said material through the groove against the cutting edge will cut excess material from the sheet.

3. A multi-purpose tool for sizing rawhide, leather and like flexible sheet material comprising:

body means;

means carried by the body means for securely anchoring the tool at a selected site for use;

means carried by the body means having at least one groove in an exposed surface thereof said exposed surface means being substantially circular in cross section and said groove therein being a trough in cross section, the depth of the trough being tapered circumferentially from beginning to end;

means carried by the body means comprising an exposed cutting edge;

means holding the exposed cutting edge contiguous with the exposed surface in angular superposition over the groove and means for selectively setting the location of superposition of the cutting edge over the groove to correspondingly set the amount of excess material and magnitude of trim to be imparted to the side edges of the resulting sheet;

whereby pulling of said material through the groove against the cutting edge will cut excess material from the sheet.

4. A multi-purpose tool for sizing rawhide, leather and like flexible sheet material comprising:

body means;

means carried by the body means for securely anchoring the tool at a selected site for use;

means carried by the body means having at least one groove in an exposed surface thereof the exposed surface being generally cylindrical, the body means comprising means slidably and rotatably receiving the generally exposed surface means and further comprising means holding the generally cylindrical exposed surface means in a selected slidable and rotational position for use;

means carried by the body means comprising an exposed cutting edge;

means holding the exposed cutting edge contiguous with the exposed surface in angular superposition over the groove;

whereby pulling of said material through the groove against the cutting edge will cut excess material from the sheet.

5. A multi-purpose tool for sizing rawhide, leather and like flexible sheet material comprising:

body means;

means carried by the body means for securely anchoring the tool at a selected site for use;

means carried by the body means having at least one groove in an exposed surface thereof;

means carried by the body means comprising an exposed cutting edge;

means holding the exposed cutting edge contiguous with the exposed surface in angular superposition over the groove the holding means and the cutting edge being biased toward the exposed surface means;

whereby pulling of said material through the groove against the cutting edge will cut excess material from the sheet.

6. A multi-purpose tool for sizing rawhide, leather and like flexible sheet material comprising:

body means;

means carried by the body means for securely anchoring the tool at a selected site for use;

means carried by the body means having at least one groove in an exposed surface thereof;

means carried by the body means comprising an exposed cutting edge;

means holding the exposed cutting edge contiguous with the exposed surface in angular superposition over the groove;

whereby pulling of said material through the groove against the cutting edge will cut excess material from the sheet;

means comprising at least one further cutting edge disposed substantially transverse to the axis of the exposed surface means through which the sheet is pulled to size the width of the strip cut therefrom.

7. A tool according to claim 6 further comprising indicia carried by the exposed surface means adjacent the further cutting edge by which said strip width is determined.

8. A tool according to claim 6 wherein the further cutting edge means comprise a plurality of spaced blades each having a cutting edge whereby several strips corresponding to said blade spacings are simultaneously cut from the sheet.

9. A tool according to claim 6 wherein said further cutting edge means are held compressively in said substantial transverse position by spacer means and set screw means.

10. A multi-purpose tool for cutting segments from rawhide, leather and like sheet material comprising:

body means;

mounting means connected to the body means by which the tool is firmly unitarily mounted at a desired site against inadvertent displacement during use bar means connected to the body means, said bar means comprising first means for sizing the thickness of the segments, second means for sizing the width of the segments and third means for shaping the side edges of the segments;

cutting edge means disposed adjacent said first, second and third means which, in conjunction with the bar means, cause the segments when pulled successively between the cutting edge means and the first, second and third means to be trimmed to the desired thickness and width and to be shaped at the side edges.

11. A method of sizing an elongated segment of rawhide leather and the like comprising the steps of releasably mounting in a stationary position a multi-purpose rawhide leather cutting tool at an exposed site, pulling the segment along a recess in a first member the depth of the recess varying from point to point, the recess comprising only a part of the entire tool against an angularly disposed cutting edge of a second member of the tool transversely bridging the recess following selectively adjusting the bridging site of the cutting edge to correlate the thickness of the segment desired with the recess depth at the bridging site without altering the mounting arrangement at the exposed site and without manually grasping any part of the tool and causing the cutting force thereby generated to be transferred to the exposed tool mounting site thereby slicing from the segment material in excess of the depth of the recess at the bridging site.

12. A method of sizing an elongated segment of rawhide leather and the like comprising the steps of releasably mounting in a stationary position a multi-purpose rawhide leather cutting tool at an exposed site, pulling a substantial width of leather through a width cutting site of the tool having at least one exposed width cutting blade and causing the cutting force thereby generated to be transferred to the exposed tool mounting site thereby shearing one or more segments therefrom having one or more desired widths and pulling at least one leather segment through a thickness cutting site of the tool having at least one exposed thickness cutting blade and causing the cutting force thereby generated to be transferred to the exposed tool mounting site thereby shearing undesired thickness from the leather segment.

13. A method of shaping an elongated segment of rawhide leather and the like comprising the steps of releasably mounting in a stationary position a multi-purpose rawhide leather cutting tool at an exposed site, pulling the segment along a trough-shaped recess having rounded corners against an angularly disposed cutting edge transversely bridging the recess without manually grasping any part of the tool and causing the cutting force thereby generated to be transferred to the exposed tool mounting site thereby slicing unwanted material from the side edges of the segment.

14. A method of shaping an elongated segment of rawhide leather and the like comprising the steps of releasably mounting in a stationary position a multi-purpose rawhide leather cutting tool at an exposed site, pulling the segment along a trough-shaped recess the depth of which varies from point to point against an angularly disposed cutting edge transversely bridging the recess after selectively adjusting the bridging site of the cutting edge to correlate the amount of unwanted side edge material with the recess depth at the bridging site without manually grasping any part of the tool and causing the cutting force thereby generated to be transferred to the exposed tool mounting site thereby slicing unwanted material from the side edges of the segment.

* * * * *